US006095902A

United States Patent [19]

Reinhardt

[11] Patent Number: 6,095,902

[45] Date of Patent: Aug. 1, 2000

[54] POLYETHER-POLYESTER POLYURETHANE POLISHING PADS AND RELATED METHODS

[75] Inventor: Heinz F. Reinhardt, Chadds Ford, Pa.

[73] Assignee: Rodel Holdings, Inc., Wilmington, Del.

[21] Appl. No.: 09/159,478

[22] Filed: Sep. 23, 1998

Related U.S. Application Data

[60] Provisional application No. 60/059,753, Sep. 23, 1997.

[51] Int. Cl.[7] ..... B24B 1/00

[52] U.S. Cl. ..... 451/36; 451/37; 451/120; 451/533; 51/297

[58] Field of Search ..... 451/36, 37, 120, 451/313, 319, 541, 542, 533; 51/297, 298

[56] References Cited

U.S. PATENT DOCUMENTS

| | | | |
|---|---|---|---|
| 3,284,274 | 11/1966 | Hulslander et al. | 161/159 |
| 3,504,457 | 4/1970 | Jacobsen et al. | 51/131 |
| 4,841,680 | 6/1989 | Hoffstein et al. | 51/283 R |
| 5,454,752 | 10/1995 | Sexton et al. . | |
| 5,603,654 | 2/1997 | Hayashi . | |
| 5,876,269 | 3/1999 | Torii . | |

*Primary Examiner*—Timothy V. Eley
*Assistant Examiner*—Willie Berry, Jr.
*Attorney, Agent, or Firm*—Konrad Kaeding; Kenneth A. Benson

[57] ABSTRACT

The present invention provides a polishing pad fabricated from both polyester and polyether polyurethanes. Methods for manufacturing the pads and methods for use of the pads for polishing are also provided.

6 Claims, No Drawings

POLYETHER-POLYESTER POLYURETHANE POLISHING PADS AND RELATED METHODS

This application claims the benefit of U.S. Provisional Application Ser. No. 60/059,753 filed Sep. 23, 1997.

BACKGROUND OF THE INVENTION

Poromeric materials are widely used for many different polishing applications. Poromerics are textile-like materials that usually contain a urethane-based impregnation or coating having a multitude of pores or cells. Use of these materials is particularly prevalent in the semiconductor industry.

Many poromeric materials used for polishing are similar to the material described in U.S. Pat. No. 3,284,274. It is believed that large macropores or cells present in the material act to hold slurry and thus aid the polishing process. U.S. Pat. No. 3,504,457 describes the use of these materials in polishing silicon semiconductor substrates.

U.S. Pat. No. 4,841,680 describes a poromeric polishing pad having a working surface comprised of a microporous polymeric material which contains open cells that have their largest opening at the work surface and are deep enough to carry a relatively large quantity of slurry. The pad is made by conventional solvent/nonsolvent polymer coagulation technology.

In addition to poromerics, polymers have been formed into nonporous polishing pads.

Both porous and nonporous prior art polishing pads exist that are formulated from either polyester or polyether polyurethanes. Each material has unique characteristics favorable for specific polishing applications. Polyethers are more hydrolitically stable and are typically used when a high degree of smoothness and planarity are needed. Polyesters are not as hydrolitically stable but are more hydrophilic. More hydrophilic materials are more readily wet and therefore facilitate the flow of polishing fluid. Polyesters also typically require less pad conditioning.

A pad that contains characteristics of both polyesters and polyethers would be beneficial.

SUMMARY OF THE INVENTION

The present invention is directed to a polishing pad fabricated from both polyester and polyether polyurethanes. The invention is further directed to methods for manufacturing the pads and methods for use of the pads for polishing.

DETAILED DESCRIPION OF THE INVENTION

Prior art polishing pads exist that are formulated from either polyester or polyether polyurethanes. Each material has unique characteristics favorable for specific polishing applications. By providing a pad comprising a urethane made from both a polyether polyol and a polyester polyol, a single pad may be used for more applications than was possible before. Three or more polyols may also be used to further refine the pad abilities. A preferred embodiment is to use co-reacted polyether/polyester polyols. Co-reacted polyether/polyester diols are commercially available.

The urethane polymers of this invention may be prepared using methods of preparation known to those skilled in the art. In one embodiment, a polyether diol and a polyester diol is added to N,N'-dimethylformamide (DMF) along with a chain extender (for instance 1,4,butanediol.) Equimolar amounts of this combination and diphenylmethane 4,4' diisocyanate (MDI) are reacted to form a mixed ether/ester polyurethane. Preferably 15–40% solids are used, more preferably 20–40% solids. A substrate, such as felt, is coated with a solution of polymer and then the coated substrate is immersed into a bath that causes coagulation of the polymer. Once the polymer has been sufficiently coagulated, the remaining solvent is leached out and the product is dried. The top skin is then removed by passing the material under a blade or under a rotating abrasive cylinder. Once the top skin is removed the underlying pores are exposed and open to the surface.

Normally for preparation of a urethane polishing pad made by the process described above one would use diols rather than a higher polyols so that the resulting polymer is not crosslinked greatly and does not gel. Examples of suitable polyisocyanates for use in making the polyurethanes of this invention include toluene diisocyanate; triphenylmethane-4,4',4"-triisocyanate; benzene-1,3,5-triisocyanate; hexamethylene diisocyanate; xylene diisocyanate; chlorophenylene diisocyanate; dicyclohexylmethane 4,4' diisocyanate; and methylenebisdiphenyl diisocyanate as well as mixtures of any of the foregoing.

The cellular elastic polymeric polishing layer or sheet may be used as such but preferably is affixed to a backing or supporting layer to form a polishing pad. For most uses the pad substrate is a flexible sheet material, such as the conventional polishing pad non-woven fibrous backings. Other types of backing may be used, including rigid impermeable membranes, such as polyester film. Preferably the polishing layer is coagulated in-situ on the pad substrate. However, for some uses it may be desirable for the pad to have an intermediate layer between the elastomeric polishing surface layer and the pad substrate, in which case the polishing layer may be coagulated on a temporary carrier film for subsequent lamination with the backing.

The function of the backing layer is primarily to serve as a vehicle for handling during processing and using the sheet material so as to prevent buckling, tearing, or applying the polishing surface in a non-uniform manner. Also the backing layer can be utilized to adjust the elastic properties of the overall polishing pad.

In another embodiment, the solid ingredients are mixed, melted, and reacted in a mold to form a cake. The cake is then skived or cut to form polishing pads. Polishing pads may also be formed from the polyester/ether urethane by extrusion, casting, injection molding, sintering, foaming, photopolymerization or other pad formation means.

Abrasive particles may be a part of the polishing pad layer formed of polyether/ester polyurethane. The abrasive may be selected from any of the known materials conventionally employed for polishing. Examples of suitable materials include diatomite (diatomaceous earth), calcium carbonate, dicalcium phosphate, pumice, silica, calcium pyrophosphate, rouge, kaolin, ceria, alumina and titania, most preferably silica, alumina, titania and ceria. Abrasive particles useful for polishing semiconductor wafers have an average particle size of less than one micron, more preferably less than 0.6 microns.

The final polymeric product preferably exhibits the following properties: a density of greater than 0.5 g/cm$^3$, more preferably greater than 0.7 g/cm$^3$ and yet more preferably greater than about 0.9 g/cm$^3$; a critical surface tension greater than or equal to 34 milliNewtons per meter; a tensile modulus of 0.02 to 5 GigaPascals; a ratio of the tensile modulus at 30° C. to the modulus at 60° C. in the range of 1.0 to 2.5; hardness of 25 to 80 Shore D; a yield stress of 300 to 6000 psi; a tensile strength of 500 to 15,000 psi, and an elongation to break up to 500%.

Since both hydrophilicity (a desired characteristic for a pad as measured by critical surface tension, mN/m) and hydrolitic stability are affected by the amount of polyether and polyester diols used in the formation of the polyurethane pad, one can balance these properties by varying the amount and types of polyethers and polyesters employed.

In a preferred embodiment, the pad material is sufficiently hydrophilic to provide a critical surface tension greater than or equal to 34 milliNewtons per meter, more preferably greater than or equal to 37 milliNewtons per meter and most preferably greater than or equal to 40 milliNewtons per meter. Critical surface tension defines the wettability of a solid surface by noting the lowest surface tension a liquid can have and still exhibit a contact angle greater than zero degrees on that solid. Thus, polymers with higher critical surface tensions are more readily wet and are therefore more hydrophilic.

Critical surface tensions for various polyethers range from 32 to 43 mN/m, for various polyesters from 39 to 43 mN/m, and for a given polyether/polyester polyurethane a value of 45 has been measured.

The present invention includes a method for polishing comprising the steps of, 1) formulating a polishing pad by one of the means described above; 2) introducing a polishing fluid containing some or no particulate material, between the pad and the workpiece to be polished; and 3) producing relative motion between the pad and the workpiece.

In accordance with the method of the present invention, one or more polishing pads are mounted on a platen of a conventional polihsing machine, such as a "Siltec" 3800 manufactured by Cybec Corp. One or more hard surfaces to be polished, such as stock polished textured surface silicon wafers, are mounted on one or more polishing heads of the polishing machine. The polishing heads and/or the platen are rotated so that there is relative motiion between the heads and platen. The polishing pad on the platen is brought into contact with the surfaces of the wafers on the polishing head, while a liquid polishing medium is fed to the polishing pad in the conventional manner. Normally the polishing medium is an aqueous slurry containing abrasive particles. In some instances abrasive particles are not a necessary part of the polishing medium.

Nothing from the above discussion is intended to be a limitation of any kind with respect to the present invention. All limitations to the present invention are intended to be found only in the claims, as provided below.

What is claimed is:

1. A polishing pad comprising a urethane made from both a polyether polyol and a polyester polyol, wherein said urethane has the following properties: a density of greater than 0.5 g/cm$^3$ a critical surface tension greater than or equal to 34 milliNewtons per meter, a tensile modulus of 0.02 to 5 GigaPascals, a ratio of tensile modulus at 30° C. to the modulus at 60° C. in the range of 1.0 to 2.5, hardness of 25 to 80 Shore D, a yield stress of 300 to 6000 psi, a tensile strength of 500 to 15000 psi, and an elongation to break up to 500%.

2. A polishing pad according to claim 1 wherein said polyether polyol and said polyester polyol are co-reacted.

3. A polishing pad according to claim 2 wherein said polyether polyol and said polyester polyol are diols.

4. A polishing pad according to claim 1 wherein said polyether polyol and said polyester polyol are diols.

5. A method for manufacturing a polishing pad comprising:

a) providing a substrate;

b) coating said substrate with a urethane polymer solution comprised of both a polyether polyol and a polyester polyol;

c) coagulating said urethane polymer;

d) drying said urethane polymer.

6. A method for manufacturing a polishing pad according to claim 5 wherein the top skin of said dried urethane polymer is removed.

* * * * *